US010869112B2

(12) United States Patent
Zhang

(10) Patent No.: US 10,869,112 B2
(45) Date of Patent: Dec. 15, 2020

(54) SPEAKER AND ELECTRONIC APPARATUS

(71) Applicant: AAC Technologies Pte. Ltd., Singapore (SG)

(72) Inventor: Zhe Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/705,228

(22) Filed: Dec. 6, 2019

(65) Prior Publication Data

US 2020/0213697 A1 Jul. 2, 2020

(30) Foreign Application Priority Data

Dec. 30, 2018 (CN) ..... 2018 2 2278789 U

(51) Int. Cl.
*H04R 1/02* (2006.01)
*H04R 1/34* (2006.01)
*H04R 1/28* (2006.01)

(52) U.S. Cl.
CPC ..... *H04R 1/025* (2013.01); *H04R 1/288* (2013.01); *H04R 1/345* (2013.01)

(58) Field of Classification Search
CPC ..... H04R 1/02; H04R 1/021; H04R 1/025; H04R 1/283; H04R 1/288; H04R 1/2873; H04R 1/345; H04R 2499/11; H04R 2499/15
See application file for complete search history.

(56) References Cited

U.S. PATENT DOCUMENTS 4,953,655 A * 9/1990 Furukawa ..... H04R 1/2819 181/156
5,675,131 A * 10/1997 Saito ..... H04R 5/02 181/152
2007/0195984 A1* 8/2007 Yang ..... H04R 1/1075 381/372
2017/0134848 A1* 5/2017 Shao ..... H04R 1/2842
2018/0014114 A1* 1/2018 Liu ..... H04R 1/2842

* cited by examiner

*Primary Examiner* — Thang V Tran
(74) *Attorney, Agent, or Firm* — W&G Law Group LLP

(57) ABSTRACT

The present disclosure provides a speaker, including a first housing having a receiving space, a speaker unit received in the receiving space and provided with a diaphragm configured to vibrate and emit sound, a second housing spaced apart from the first housing, and a connecting member communicating the second housing with the first housing. The diaphragm divides the receiving space into a front acoustic cavity and a rear acoustic cavity, and the diaphragm is spaced apart from the first housing that faces right the diaphragm so as to form the front acoustic cavity. The second housing has an auxiliary acoustic cavity, and the connecting member communicates the auxiliary acoustic cavity with the rear acoustic cavity. The speaker improves a low-frequency performance of the speaker; the electronic apparatus adopting the speaker can utilize an internal unoccupied space as the auxiliary acoustic cavity, thereby improving the low-frequency performance of the electronic apparatus.

14 Claims, 3 Drawing Sheets

SPEAKER AND ELECTRONIC APPARATUS

TECHNICAL FIELD

The present disclosure relates to the technical field of the electroacoustic conversion, and particularly, to a speaker and an electronic apparatus.

BACKGROUND

With the rapid development of mobile devices (such as mobile phones, tablets or laptops), the requirements on functions of products are increasingly higher. In order to enhance entertainment effects, more and more speakers adopt a structure of the speaker combined with a BOX, so as to constitute an electronic apparatus capable of providing a better low-frequency experience.

In the related art, inside of the electronic apparatus such as a mobile phone, there are gap spaces formed by various stacked components, and these gap spaces are unoccupied and unutilized.

Therefore, it is urgent to provide a novel speaker and an electronic apparatus to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
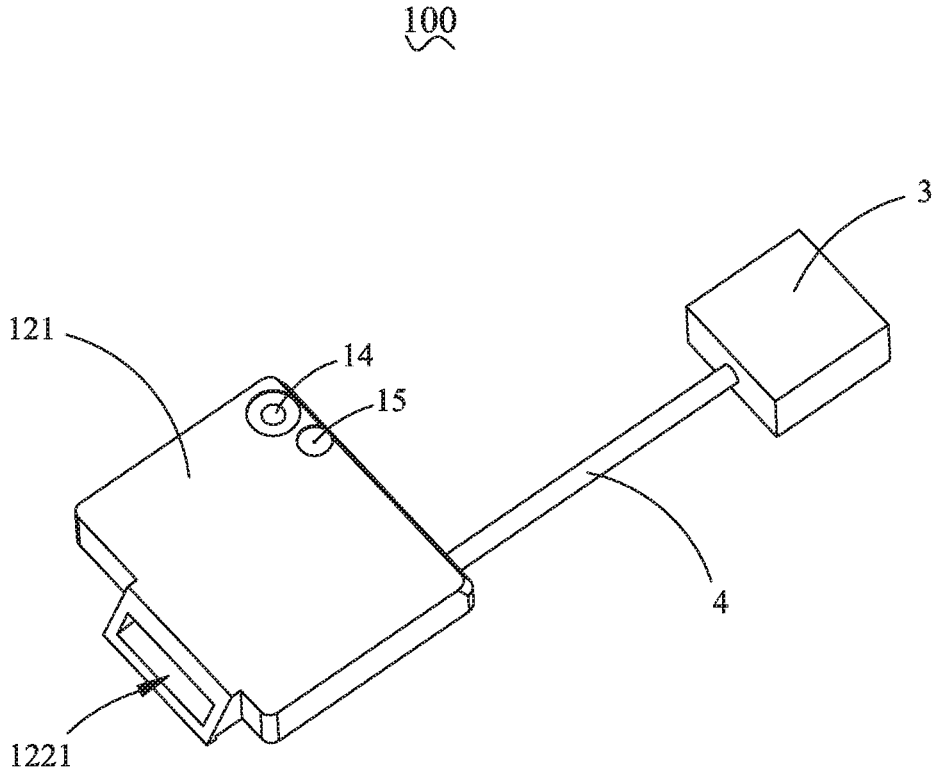
FIG. 1 is a perspective structural diagram of a speaker of the present disclosure.
Figure 2:
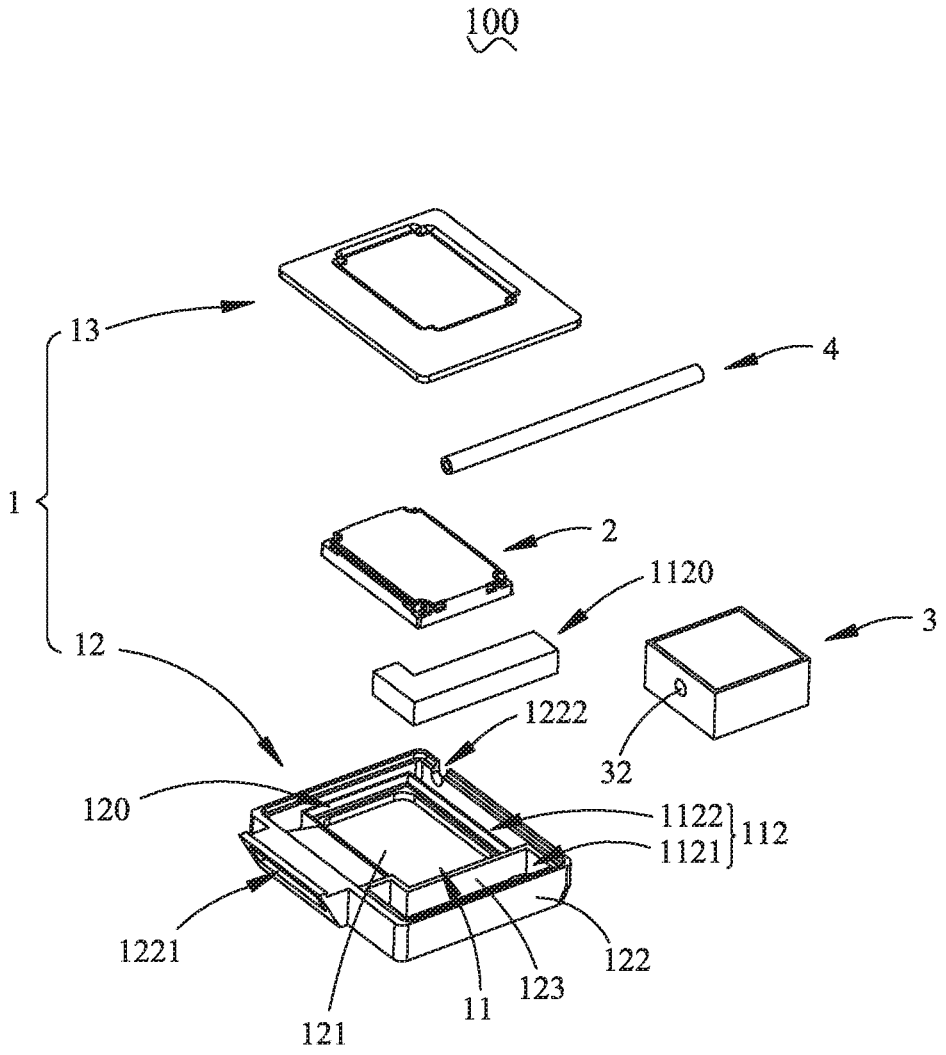
FIG. 2 is an exploded view of a speaker of the present disclosure.

Referring to FIG. 1 and FIG. 2, the present disclosure provides a speaker 100. The speaker 100 includes a first housing 1 having a receiving space 11, a speaker unit 2 received in the receiving space 11 and provided with a diaphragm 21 configured to vibrate and emit sound, a second housing 3 spaced apart from the first housing 1 and having an auxiliary acoustic cavity 31, and a connecting member 4 communicating the second housing 3 with the first housing 1. The diaphragm 21 divides the receiving space 11 into a front acoustic cavity 111 and a rear acoustic cavity 112. The diaphragm 21 is spaced apart from the first housing 1 that faces right the diaphragm 21 to form the front acoustic cavity 111. The connecting member 4 communicates the auxiliary acoustic cavity 31 with the rear acoustic cavity 112.

Figure 3:
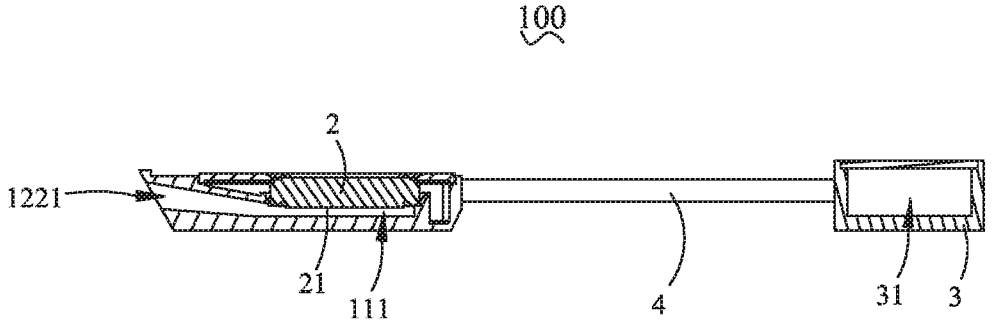
FIG. 3 is a cross-sectional view of a speaker of the present disclosure.

Further, referring to FIG. 3, the first housing 1 includes a body 12 having an opening 120, and a cover plate 13 that covers the opening 120 and defines the receiving space 11 together with the body 12. The body 12 includes a bottom plate 121 facing right the diaphragm 21, and a sidewall 122 extending from an edge of the bottom plate 121 towards the cover plate 13 and connected to the cover plate 13. An end of the sidewall 122 facing away from the bottom plate defines the opening 120. The body 12 further includes a blocking wall 123 extending from the bottom plate 121 towards the inside of the receiving space 11. The blocking wall 123 divides the rear acoustic cavity 112 into a first rear acoustic cavity 1121, and a second rear acoustic cavity 1122 corresponding to the speaker unit 2. The first rear acoustic cavity 1121 is filled and sealed with a sound absorbing material 1120. One end of the connecting member 4 is in communication with the second rear acoustic cavity 1122, and the other end of the connecting member 4 is in communication with the auxiliary acoustic cavity 31.

A sound guiding channel 1221 communicating the front acoustic cavity 111 with the outside is formed by the sidewall 122. The sound guiding channel 1221 is disposed to be opposite to an end of the connecting member 4 close to the first housing 1. The first housing 1 is provided with a filling hole 14 corresponding to the first rear acoustic cavity 1121. The sound absorbing material 1120 is a sound absorbing powder material. The sound absorbing material 1120 is filled into the first rear acoustic cavity 1121 through the filling hole 14. The first housing 1 is further provided with a discharging hole 15 corresponding to the second rear acoustic cavity 1122.

One or more second housings 3 are provided. Each second housing 3 is provided with a through-hole 32 corresponding to the connecting member 4. One end of the connecting member 4 close to the second housing 3 is fixed in the through-hole 32 and extends into the auxiliary acoustic cavity 31 through the through-hole 32.

One or more connecting members 4 are provided. Each connecting member 4 has a hollow tubular structure with two open ends. A mounting portion 1222 is opened on and penetrates the sidewall 122 corresponding to the connecting member 4, and the end of the connecting member 4 close to the first housing 1 is fixed in the mounting portion 1222. The mounting portion 1222 is a mounting hole penetrating the sidewall 122 or a mounting notch formed by recessing from an edge of the sidewall 122 towards the bottom plate 121.

Figure 4:
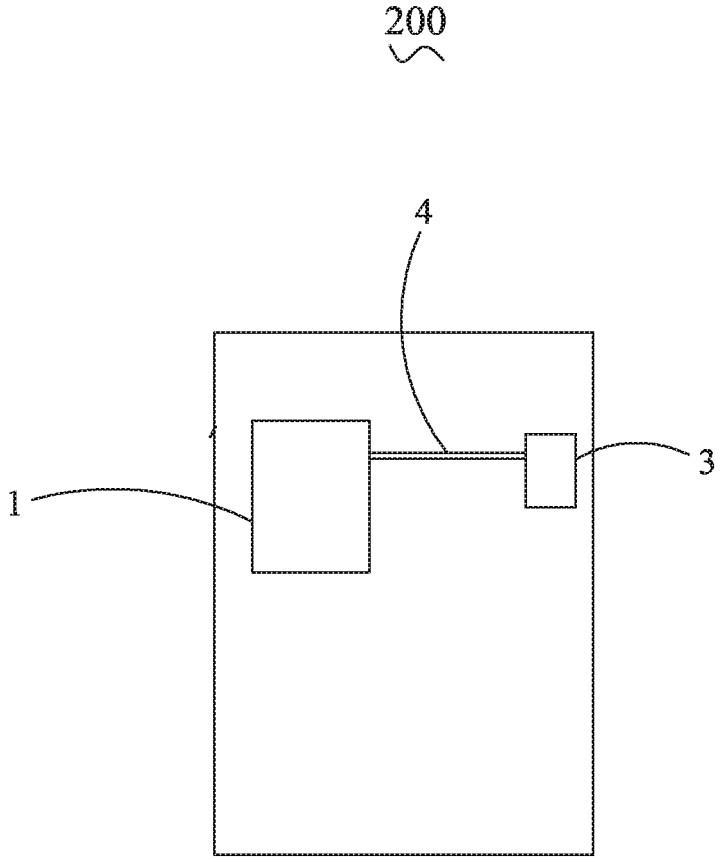
FIG. 4 is a structural schematic diagram of an electronic apparatus of the present disclosure.

Further referring to FIG. 4, the present disclosure further provides an electronic apparatus 200, and the electronic apparatus 200 includes the speaker 100.

Compared with the related art, the present disclosure has following beneficial effects: the speaker, by providing the second housing with the auxiliary acoustic cavity, improves a low-frequency performance of the speaker; the electronic apparatus employing the speaker can utilize an internal unoccupied space as the auxiliary acoustic cavity, thereby improving the low-frequency performance of the electronic apparatus.

The above described embodiments are merely intended to illustrate the present disclosure, and it should be noted that, without departing from the inventive concept of the present disclosure, the improvements made by those skilled in the related art shall fall within the protection scope of the present disclosure.

What is claimed is:

1. A speaker, comprising:

a first housing having a receiving space;

a speaker unit received in the receiving space and provided with a diaphragm configured to vibrate and emit sound, the diaphragm dividing the receiving space into a front acoustic cavity and a rear acoustic cavity, and the diaphragm being spaced apart from the first housing that faces right the diaphragm to form the front acoustic cavity;

a second housing spaced apart from the first housing; and a connecting member communicating the second housing with the first housing, wherein the second housing has an auxiliary acoustic cavity, and the connecting member communicates the auxiliary acoustic cavity with the rear acoustic cavity; wherein, the first housing comprises a body having an opening, and a cover plate covering the opening and defining the receiving space together with the body, the body comprises a bottom plate facing right the diaphragm, a sidewall extending from an edge of the bottom plate towards the cover plate and connected to the cover plate, and a blocking wall extending from the bottom plate towards an inside of the receiving space, the blocking wall divides the rear acoustic cavity into a first rear acoustic cavity, and a second rear acoustic cavity corresponding to the speaker unit, a sound absorbing material is encapsulated in the first rear acoustic cavity, one end of the connecting member is in communication with the second rear acoustic cavity, and the other end of the connecting member is in communication with the auxiliary acoustic cavity.

2. The speaker as described in claim 1, wherein one or more connecting member are provided.

3. The speaker as described in claim 1, wherein the connecting member is a hollow tubular structure having two open ends, a mounting portion is opened on and penetrates the sidewall corresponding to the connecting member, and an end of the connecting member close to the first housing is fixed in the mounting portion.

4. The speaker as described in claim 3, wherein the mounting portion is a mounting hole penetrating the sidewall, or a mounting notch formed by recessing from an edge of the sidewall towards the bottom plate.

5. The speaker as described in claim 3, wherein the second housing is provided with a through-hole corresponding to the connecting member, and an end of the connecting member close to the second housing is fixed in the through-hole and extends into the auxiliary acoustic cavity through the through-hole.

6. The speaker as described in claim 1, wherein the sidewall forms a sound guiding channel that communicates the front acoustic cavity with outside, and the sound guiding channel is disposed to be opposite to an end of the connecting member close to the first housing.

7. The speaker as described in claim 1, wherein the first housing is provided with a filling hole corresponding to the first rear acoustic cavity, the sound absorbing material is a sound absorbing powder material, and the sound absorbing material is filled into the first rear acoustic cavity through the filling hole.

8. The speaker as described in claim 1, wherein the first housing is provided with a discharging hole corresponding to the second rear acoustic cavity.

9. An electronic apparatus, comprising the speaker as described in claim 1.

10. An electronic apparatus, comprising the speaker as described in claim 2.

11. An electronic apparatus, comprising the speaker as described in claim 3.

12. An electronic apparatus, comprising the speaker as described in claim 4.

13. An electronic apparatus, comprising the speaker as described in claim 5.

14. An electronic apparatus, comprising the speaker as described in claim 6.

* * * * *